US009132331B2

(12) United States Patent
Ishii et al.

(10) Patent No.: US 9,132,331 B2
(45) Date of Patent: Sep. 15, 2015

(54) MICROPHONE ARRAY AND METHOD OF USE

(75) Inventors: Hideyuki Ishii, Portland, OR (US); Takanobu Nishiura, Kyoto (JP); Hiroyuki Mashimo, Chiba (JP); Yutaka Kabeshita, Portland, OR (US); Nicholas A. Leech, Aloha, OR (US); Arthur Molinari, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 755 days.

(21) Appl. No.: 13/048,665

(22) Filed: Mar. 15, 2011

(65) Prior Publication Data

US 2012/0070009 A1 Mar. 22, 2012

Related U.S. Application Data

(60) Provisional application No. 61/315,734, filed on Mar. 19, 2010.

(51) Int. Cl.

| | |
|---|---|
| ***A63B 69/36*** | (2006.01) |
| *H04R 29/00* | (2006.01) |
| *H04R 1/40* | (2006.01) |

(Continued)

(52) U.S. Cl.

CPC ..... *A63B 69/3623* (2013.01); *A63B 67/04* (2013.01); *A63B 69/0002* (2013.01); *A63B 69/38* (2013.01); *A63B 2069/0008* (2013.01); *A63B 2220/808* (2013.01); *H04R 1/406* (2013.01);

(Continued)

(58) Field of Classification Search

CPC .... H04R 29/00; H04R 29/004; H04R 29/005; H04R 29/006; H04R 29/008; H04R 3/005; H04R 3/10; H04R 1/406; H04R 2201/40; H04R 2201/401; H04R 2201/403; H04R 2201/405; A63B 47/008; A63B 59/0074; A63B 67/04; A63B 69/0002; A63B 69/0008; A63B 69/38; A63B 69/3623

USPC ..... 381/56, 87, 122, 355–361, 337, 61, 58, 381/95; 181/161, 175–179, 185–186; 473/140, 151, 198, 209, 224; 73/1.46, 73/11.01, 12.01, 12.02

See application file for complete search history.

(56) References Cited

U.S. PATENT DOCUMENTS

| | | | |
|---|---|---|---|
| 2,299,342 | A | 10/1942 | Olson |
| 4,559,642 | A | 12/1985 | Miyaji et al. |

(Continued)

FOREIGN PATENT DOCUMENTS

| | | | |
|---|---|---|---|
| JP | 50104959 | | 8/1975 |
| JP | 62257029 | A | 11/1987 |

(Continued)

OTHER PUBLICATIONS

Examiner's Report in Canadian Patent Application No. 2734003, mailed on Jun. 3, 2011.

(Continued)

*Primary Examiner* — Xu Mei

(74) *Attorney, Agent, or Firm* — Honigman Miller Schwartz & Cohn LLP; Anna M. Budde; Jonathan P. O'Brien

(57) ABSTRACT

A system for capturing high quality sound information from an impact includes a microphone stand and microphone array. The microphone stand is configured so that the microphone array arranged thereupon is focused on a single point so that ambient noise may be reduced.

16 Claims, 13 Drawing Sheets

(51) Int. Cl.

| | |
|---|---|
| *H04R 3/00* | (2006.01) |
| *A63B 67/04* | (2006.01) |
| *A63B 69/00* | (2006.01) |
| *A63B 69/38* | (2006.01) |

(52) U.S. Cl.

CPC ..... *H04R 3/005* (2013.01); *H04R 29/005* (2013.01); *H04R 2201/401* (2013.01)

(56) References Cited

U.S. PATENT DOCUMENTS

| | | | | |
|---|---|---|---|---|
| 5,056,791 | A | 10/1991 | Poillon et al. | |
| 5,062,641 | A | 11/1991 | Poillon et al. | |
| 5,103,927 | A | 4/1992 | Heavener | |
| 5,260,920 | A | 11/1993 | Ide et al. | |
| 5,303,924 | A * | 4/1994 | Kluttz et al. | 473/155 |
| 5,490,599 | A | 2/1996 | Tohidi | |
| 5,632,688 | A * | 5/1997 | Blaakman | 473/198 |
| 6,168,030 | B1 | 1/2001 | Morris | |
| 6,292,130 | B1 | 9/2001 | Cavallaro et al. | |
| 6,293,802 | B1 | 9/2001 | Ahlgren | |
| 6,371,862 | B1 | 4/2002 | Reda | |
| 6,760,449 | B1 | 7/2004 | Matsuo | |
| 7,030,905 | B2 * | 4/2006 | Carlbom et al. | 348/157 |
| 7,035,744 | B2 * | 4/2006 | Cheriet et al. | 702/77 |
| 7,046,812 | B1 * | 5/2006 | Kochanski et al. | 381/92 |
| 7,316,162 | B2 | 1/2008 | Hald | |
| 7,366,308 | B1 * | 4/2008 | Kock | 381/92 |
| 2005/0197198 | A1 | 9/2005 | Otten et al. | |
| 2005/0202887 | A1 | 9/2005 | Otten et al. | |
| 2007/0025562 | A1 | 2/2007 | Zalewski et al. | |
| 2007/0213139 | A1 | 9/2007 | Stivers et al. | |
| 2008/0034869 | A1 | 2/2008 | Heinz et al. | |
| 2008/0039222 | A1 | 2/2008 | Kiraly | |
| 2008/0207347 | A1 | 8/2008 | Rose | |
| 2009/0207131 | A1 | 8/2009 | Togami et al. | |
| 2011/0009215 | A1 | 1/2011 | Ichikawa et al. | |

FOREIGN PATENT DOCUMENTS

| | | | |
|---|---|---|---|
| JP | 10267744 | A | 10/1998 |
| JP | 2002091469 | | 3/2002 |
| JP | 2002135642 | | 5/2002 |
| JP | 2008065675 | | 3/2008 |

OTHER PUBLICATIONS

Response to Examiner's Report in Canadian Patent Application No. 2734003, filed on Sep. 2, 2011.

Examiner's Report in Canadian Patent Application No. 2734003, mailed on Jan. 31, 2012.

Response to Examiner's Report in Canadian Patent Application No. 2734003, filed on Apr. 25, 2012.

Response to Examiner's Report in Canadian Patent Application No. 2734003, filed on Sep. 24, 2012.

Examiner's Report in Canadian Patent Application No. 2734003, mailed on Dec. 7, 2012.

Examiner's Report in Canadian Patent Application No. 2,734,003, mailed on Jun. 28, 2012.

Japanese Office Action in connection with Japanese Application No. 2011-056998 mailed on Nov. 5, 2013; 2 pages.

Examiner's Report mailed May 21, 2013 for Canadian Patent Application No. 2,734,003.

* cited by examiner

EQ. 1

$$\tau_n = r_n / c$$

EQ. 2

$$y(t) = \sum_{n=1}^{N} x_i(t - \tau_n)$$

FIG. 12

(a) MIC. INTERVAL 6cm LOW FREQ.

(b) MIC. INTERVAL 6cm MID. FREQ.

(c) MIC. INTERVAL 6cm HIGH FREQ.

(d) MIC. INTERVAL 12cm LOW FREQ.

(e) MIC. INTERVAL 12cm MID. FREQ.

(f) MIC. INTERVAL 12cm HIGH FREQ.

MICROPHONE ARRAY AND METHOD OF USE

CROSS-REFERENCE TO RELATED APPLICATION

This application claims priority under 35 U.S.C. §119(e) to U.S. Provisional Patent Application No. 61/315,734, entitled "Microphone Array and Method of Use", and filed on Mar. 19, 2010, which application is hereby incorporated by reference.

BACKGROUND

The present disclosure relates generally to a system and method for determining the impact sound generated by the impact of a striking object and an athletic projectile. More specifically, the present disclosure relates generally to a system and method for determining the sound of a golf club striking a golf ball.

The sound generated when a golf club impacts a golf ball may be unique to the particular club-ball combination. For example, the material of the club face, whether the club is a driver, an iron, or a putter, and the construction of the golf ball and its component materials may all influence the particular sound generated by the impact of the club and ball. The sound generated may also depend on other factors, such as the temperature of the equipment, the ambient temperature, the location of impact on the club face, the club head speed, and the angle of attack, in addition to other factors.

Many golfers consider the sound of a correctly hit ball as a factor in ball purchase, as this sound may be aesthetically pleasing or convey information as to the accuracy of the ball hit. Therefore, one tool that may be useful in designing a ball may be a tool that allows a designer to know with accuracy the sound profile generated by an impact with the ball.

SUMMARY

In one aspect, a first embodiment provides a sound capturing system comprising a microphone stand for supporting a plurality of microphones. The microphone stand has a base having a first curvature and an arm associated with the base. The arm having a second curvature. The arm is positioned substantially perpendicular to the base. The first curvature and the second curvature are selected so that any microphone positioned on the microphone stand is focused on a single point a known distance from the microphone stand.

In another embodiment, a microphone stand comprises a base and an arm associated with the base. The base occupies a first plane and the arm occupies a second, different plane. The base, which has a first curvature, is configured to support a first microphone, the first microphone directed to a first focal point. The arm, which has a second curvature, is configured to support a second microphone, the second microphone directed to a second focal point. The first curvature and the second curvature are selected so that first focal point and the second focal point are substantially the same point.

In another embodiment, a method for detecting a high quality impact sound generated by a striking object impacting a projectile at an impact location comprises deploying a plurality of microphones, wherein each microphone in the plurality of microphones is positioned a known distance from any other microphone in the plurality of microphones, and wherein each microphone in the plurality of microphones is focused on the impact location. In another step, the impact sound is received at one or more of the microphones in the microphone array so that one or more of the microphones generates an impact signal. The impact signal may be communicated to an analysis module. The impact signal can be analyzed to determine the high quality impact sound.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 12 shows two possible equations for use in determining time delay in a microphone array;

DETAILED DESCRIPTION

Figure 2:
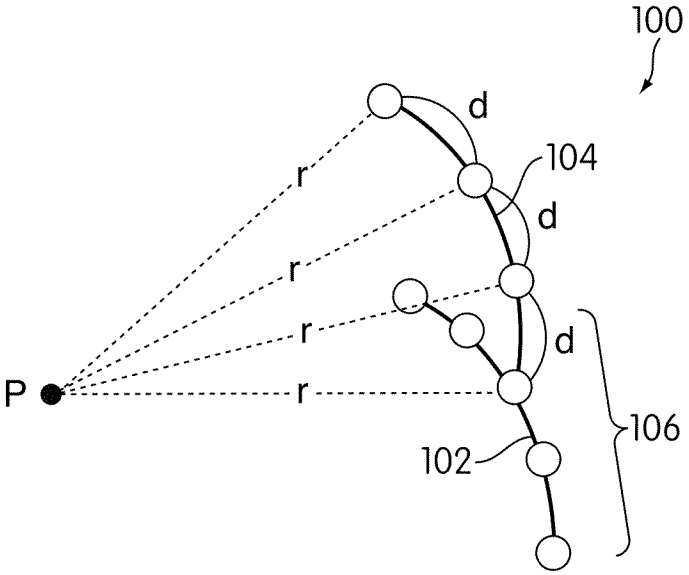
FIG. 2 is a schematic side view of an embodiment of a microphone array stand with a plurality of microphones associated therewith.

The present embodiments relate to a system and method for discerning a high quality sound profile for a particular combination of a striking object and a projectile. The striking object may be any type of striking object. For example, in athletics, the striking object may be a diamond sports bat, any other type of bat, a paddle, a racket, and a club. Similarly, the projectile may be any projectile. For example, in athletics, the projectile may be any type of ball, including but not limited to a baseball, a softball, a tennis ball, a ping pong/table tennis ball, a cricket ball, a squash ball, a racket ball, and a golf ball. The discussion herein is generally limited to a discussion of a system focused on determining a sound profile for a golf club and a golf ball, but the striking object and projectile should not considered to be so limited.

High quality extraction of impact sounds at the time of impact may be desired for various reasons. For example, in some cases, the design of the striking object and/or the projectile may be influenced by the sound profile generated at impact. For example, in athletics, such as baseball, tennis, golf, or table tennis, rapid improvements of the equipment may be assisted if the impact sound with a ball can be extracted and/or analyzed with high quality.

In general, the impact of a striking object with a projectile may be considered to occur at a point sound source. In order to extract the impact sound with high quality, a microphone is generally set up proximate the impact point. However, as is known in the art, ambient noise greatly influences the detection of sounds at the impact point with a ball in the field, so extraction of high quality impact sound is difficult, even if a microphone is closely apposed. The ambient noise may be wind, spectators, or even the noise made by the striking object as the striking object moves rapidly through the air. The system and methods described herein are designed in part to permit extraction of high quality impact point sound source regardless of ambient noise pollution of the signal.

In some embodiments, instead of using a single microphone to capture the impact noise, a microphone array is provided to capture the impact sound. FIGS. 1-8 show various schematics and embodiments of a microphone array suited to capturing an impact sound while generally disregarding ambient noise. The microphone array is able to disregard ambient noise, in part, by providing a plurality of microphones 106 situated on a microphone stand 100 that includes a base 102 associated with an arm 104. In some embodiments, microphone stand 100 positions microphones 106 thereupon to focus each microphone on a single target point P, as is shown schematically in FIGS. 1 and 2.

Microphone stand 100 may be made of any material known in the art, such as metals, plastics, ceramics, natural and synthetic composite materials, and the like. In some embodiments, the material of microphone stand 100 may be selected to be relatively inert to the frequencies and/or frequency spectrum of the anticipated impact sound so that microphone stand 100 may not vibrate in response to the sound waves generated by the impact and contaminate the data received at or by microphones 106. For example, microphone stand 100 may be made from a relatively rigid plastic or metal.

Microphone stand 100 may have any shape or configuration desired by a user. Though specific measurements are shown in FIGS. 3-8, it should be understood that these measurements reflect only one embodiment of microphone stand 100. In other embodiments, the dimensions of microphone stand 100 may be different, such as with longer or shorter lengths, distances, and heights, more acute or more obtuse angles, and greater or smaller radii of curvatures.

For example, microphone stand 100 may extend in substantially one direction or plane, or microphone stand 100 may extend in multiple directions or planes. As is shown in FIGS. 1-8, in some embodiments, base 102 extends substantially in a first plane while arm 104 extends substantially in an orthogonal or perpendicular plane. In some embodiments, base 102 and/or arm 104 may be straight, but in other embodiments at least one of base 102 and arm 104 are curved, i.e., have a radius of curvature. The radius of curvature of either or both of base 102 and arm 104 may be selected to assist microphones 106 in focusing on target point P, though any radius of curvature may be employed by either or both of base 102 and arm 104. Generally, less curvature to base 102 and/or arm 104 pushes the focal point or target point P further away from microphone stand 100.

Figure 7:
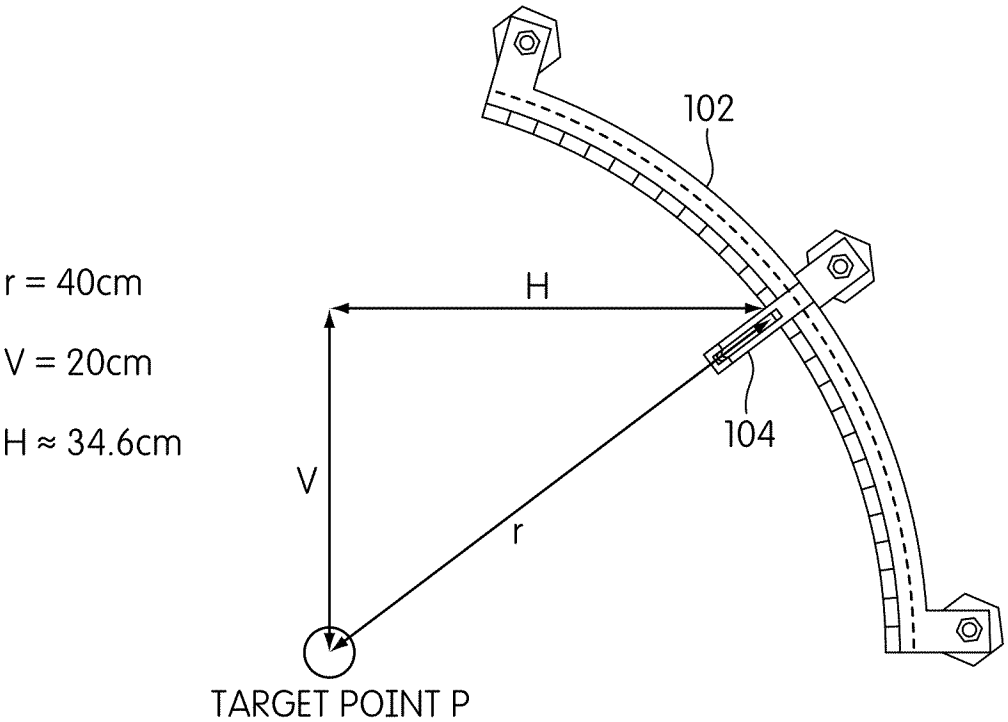
FIG. 7 is a top view of an embodiment of a microphone array stand configured to focus each microphone associated therewith to a focal point.
Figure 8:
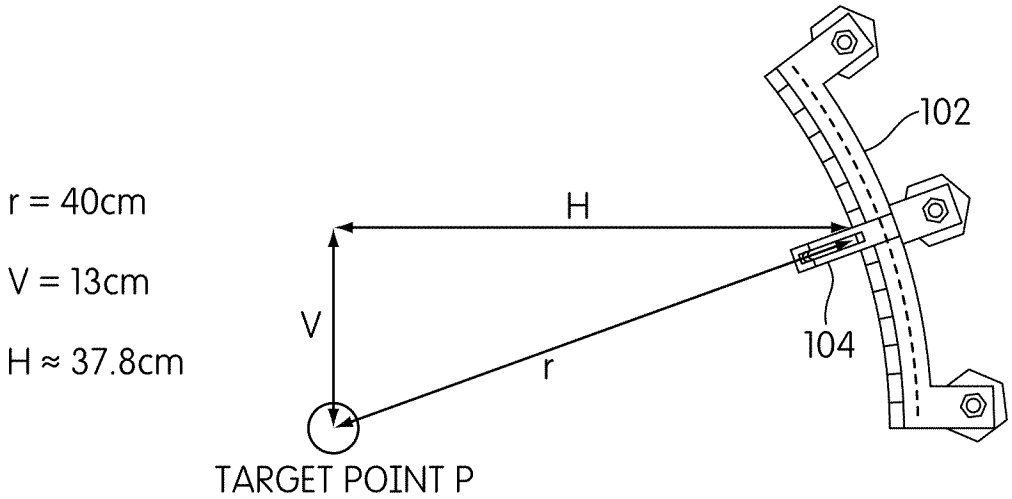
FIG. 8 is a top view of an embodiment of a microphone array stand configured to focus each microphone associated therewith to a focal point.

Similarly, the length of base 102 and/or arm 104 may be any length desired by a user. In some embodiments, however, the length of base 102 and/or arm 104 may be selected to assist in the positioning of microphone stand 100 at an optimal distance from target point P. For example, as shown in FIGS. 7 and 8, two different embodiments of microphone stands 100 are shown. Both embodiments of microphone stand 100 are intended to be positioned at the same focal length r from target point P, which in the embodiment shown in the FIGS. is about 40 cm. However, in the embodiment shown in FIG. 7, base 102 and arm 104 are longer than in the embodiment shown in FIG. 8. As shown in FIG. 7, the lengths of base 102 and arm 104 require that a center point of microphone stand 100 is positioned a vertical distance V of about 20 cm from target point P and a horizontal distance H of about 34.6 cm from target point P. As shown in FIG. 8, the length of base 102 and arm 104 are generally shorter than the length of base 102 and arm 104 of the embodiment of microphone stand shown in FIG. 7. The embodiment of microphone stand 100 shown in FIG. 8 allows the center point of microphone stand 100 to be positioned a vertical distance V of about 13 cm from target point P and a horizontal distance H of about 37.8 cm from target point P. Therefore, the lengths of base 102 and arm 104 in the embodiment shown in FIG. 8 allow microphone stand 100 to be positioned further away on a horizontal axis from target point P than the embodiment of microphone stand 100 shown in FIG. 7. Such a configuration as shown in FIG. 8 may be advantageous in some circumstances over the configuration shown in FIG. 7, as the larger, horizontally closer microphone stand 100 as shown in FIG. 7 may affect or interfere with a golfer's swing, for example.

Base 102 and arm 104 may be configured to associate microphones 106 using any method known in the art. For example, holes, divots, indentations, recesses, or the like may be provided to receive microphones 106. Mechanical connectors such as clips, rivets, brackets, or the like may be provided to secure microphones 106 in position.

Additionally, base 102 and/or arm 104 may be configured to be secured to a surface, such as a floor, table, or work surface during use. As shown in FIGS. 3-8, base 102 includes provisions for bolting or screwing base 102 to a surface. In other embodiments, microphone stand 100 may be incorporated into a single box that includes various tools for analysis, such as a sound board, computer, and display.

Microphones 106 may be any type of microphone known in the art, such as omnidirectional or directional microphones. In the embodiments where microphone stand 100 is configured to focus microphones 106 on target point P, directional microphones may prove beneficial. Microphones 106 may be selected because microphones 106 may perform well under certain desirable situations. For example, a typical midrange value of the frequency range of the impact sound generated by the impact of a golf club with a golf ball is around 3000 Hz or from around 4000 Hz to around 5000 Hz.

Therefore, microphones 106 that perform well in these frequency ranges may be selected for a golf sound capturing system.

Microphones 106 may be positioned on microphone stand 100 in any desired configuration. However, the relative positions of microphones 106 on microphone stand 100 may be selected for optimal sound gathering for various types of sounds. For example, the positioning of microphones 106 may be different for golf than for baseball, even if the same size microphone stand 100 is used for both sports. In order to take advantage of time shift delay determination, described further below, the actual positioning of microphones 106 on microphone stand 100 is less important that knowing the position and/or relative position of microphones 106 with precision.

Any number of microphones 106 may be provided on microphone 100. In some embodiments particularly suited to golf, eight (8) microphones are provided, with four (4) microphones evenly spaced apart on base 102 and four (4) microphones evenly spaced apart on arm 104.

Figure 10:
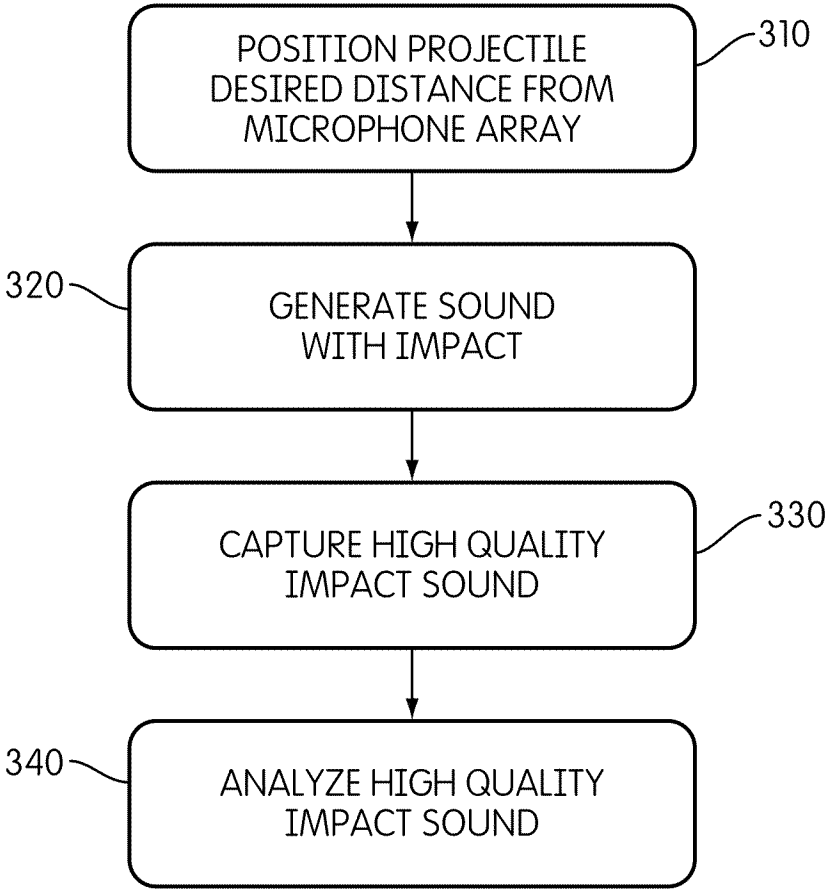
FIG. 10 is a flow chart showing an embodiment of a method of obtaining a high quality impact sound.

A sound capturing system may be used in an embodiment of a method as shown in FIG. 10, though in other embodiments, the sound capturing systems described herein may be used in other ways. Though presented in a specific order, one or more steps of the method shown in FIG. 10 may be performed out of this sequence.

In a first step 310, the projectile, such as a golf ball, is positioned a desired distance from the microphone array. For example, as shown in FIGS. 7 and 8, a golf ball may be positioned approximately 40 cm from a center point of the microphone array. The selection of 40 cm as the focal or target point P is discussed further below. In a second step 320, an impact sound is generated, such as by striking the projectile with a striking object. For example, a golfer may hit a golf ball with a golf club. In a third step 330, the impact sound is captured, such as with a microphone array as described and shown above with respect to FIGS. 1-8. In a fourth step 340, the high quality impact sound is analyzed.

Figure 11:
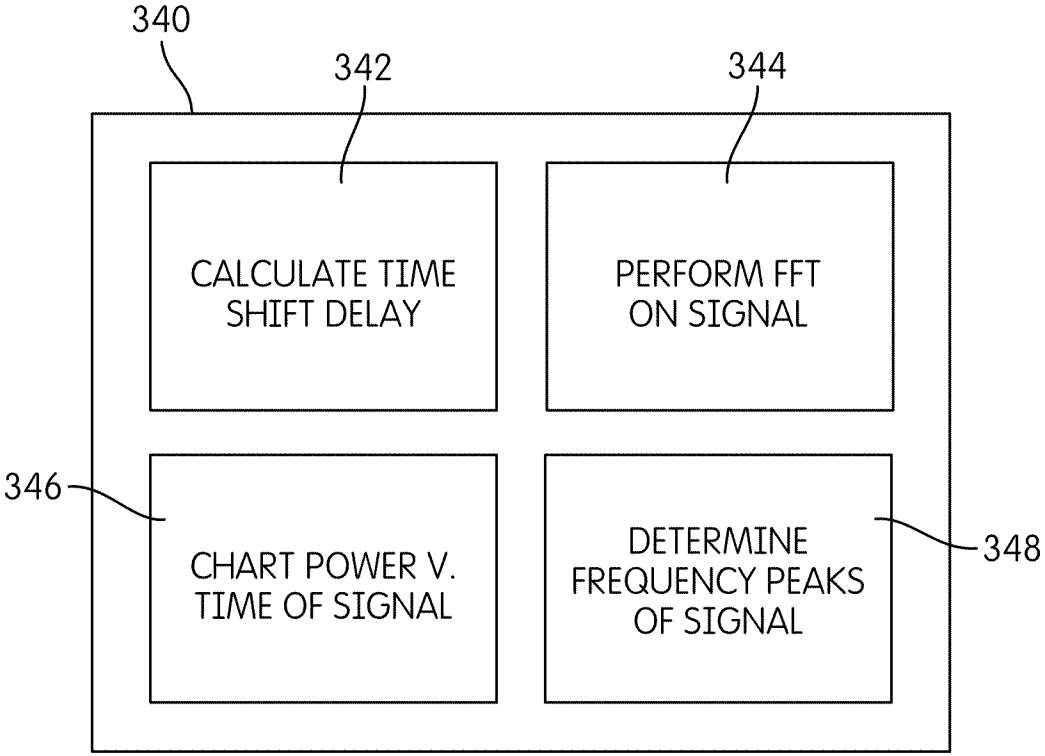
FIG. 11 is a flow chart showing various possibilities for analyzing a received acoustic signal.

FIG. 11 shows various ways in which the high quality impact sound may be analyzed. As is known in the art, microphones translate sound waves into electrical signals. These electrical signals may be transmitted via any method known in the art such as via a wireless transmission or a wireline transmission, to an analysis module. The analysis module may be any type of machine or tool capable of receiving microphone signals. For example, the analysis module may be an oscilloscope or a computer, which may be a processor that may be associated with one or more input/output devices, such as a keyboard, voice input, display, touch screen, or the like. The analysis module may be programmed to perform any number of analyses on the received microphone signal. In a simplistic form, the analysis may entail only the display of the raw signal data.

One type of analysis that may be performed is a fast Fourier transform (FFT) on the signal, as shown in step 344. This type of analysis will allow a user to generate a spectrograph. In the spectrograph, the user may see the frequency distribution, chart the power in decibels versus time (in step 346), the Hz, determine the frequency peaks of the signal (in step 348), or the like.

Figure 9:
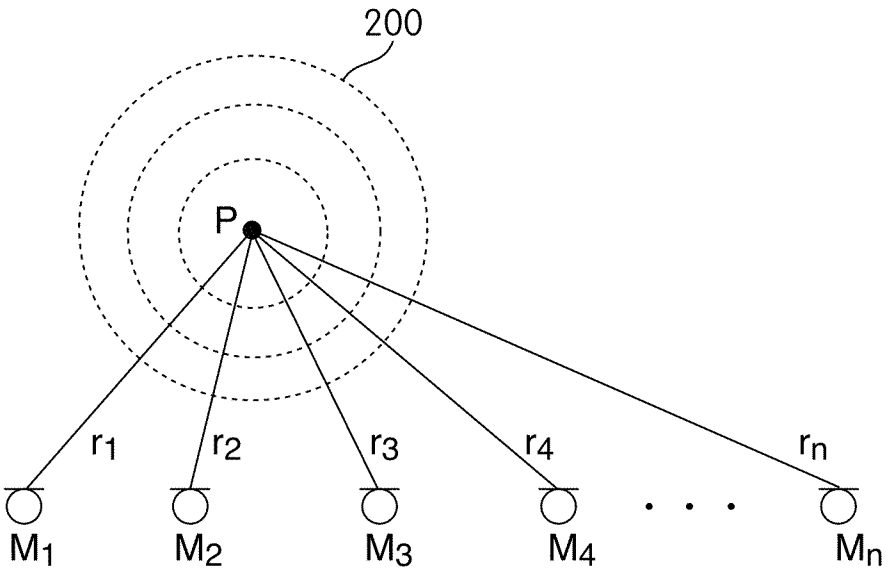
FIG. 9 is a schematic diagram showing how a spherical wave reaches each microphone in a spaced-apart microphone array at a different time due to the different travel distance.

Another type of analysis that may be performed is shown generally in step 342, where the time shift delay is calculated. Microphone arrays are used in a type of signal-processing technology which can record a target sound, also known as a request signal or impact sound, in a high signal to noise (SN) ratio using multiple microphones. The method for analyzing the signals generated by the multiple microphones is generally a delay sum array. As is known in the art, the delay sum array is a method of forming sharp directivity in the system by summing the microphone signals from each microphone, after adding the time delay to the sound reception signal from each microphone. The time delay is generated due to the geometry of the microphone array. As shown in FIG. 9, a spherical wave 200 is spread from a point sound source P is indicated by the dotted lines. Mn indicates a microphone, $r_n$ indicates the distance from point sound source P to each microphone, and n indicates the microphone number. When the position of point sound source P is known, the arrival of spherical wave 200 at each microphone Mn can be determined according to the point sound source and the microphone distance $r_n$. Moreover, it is possible to keep the distortion to the target sound to a minimum in comparison with other array signal-processing methods.

When calculating a time delay for the arrival of the wavefront at various microphones, the wavefront arrival at each microphone becomes the spherical wave in the case of the request signal is a point sound source. Therefore, the temporal delay of each microphone can be expressed with EQ. 1 shown in FIG. 12. In EQ. 1, $\tau_n$ indicates the temporal delay, $r_n$ indicates the distance from the point sound source P to each microphone, n indicates the microphone number, and c indicates the speed of sound. Furthermore, the array output as a grand total of the delay addition signal, can be expressed as shown in EQ. 2 shown in FIG. 12, where y(t) inidcates the array output signal, $\chi_i(t-\tau_n)$ indicates the input delay addition signal, and N indicates the number of microphones.

Testing Scenario 1

In the sports field, when recording the impact point with a ball, extraction of a robust or high quality impact sound is attained in the dark noise by installing microphones near the colliding point. However, in the case of the impact sound generated on swinging the equipment such as the case of baseball, tennis, golf, or table tennis, there is a problem wind noise being recorded simultaneously with the impact sound generated by the swinging and striking motions. To reduce this effect, the microphone is adjoined to the impact point close to the impact point to minimize the significant influence of the wind noise, but this makes recording in high quality very difficult. Various experiments were conducted to determine how the high quality extraction of the impact sound is influenced by the wind noise using a microphone array.

Experiment Outline

First, in order to examine a location less influenced by wind noise, recording of the impact sound near the sound source was performed. The recording setup is shown schematically in FIG. 13, and the recording conditions are shown in Table 1.

TABLE 1

| Recording Conditions | |
|---|---|
| Sampling Frequency | 48 KHz |
| Microphone Type | Sony, ECM66B |
| Microphone Amp. | HEG, MICA-800A |
| A/D, D/A | Inrevium, TD-BD-16A DUSB |

Figure 13:
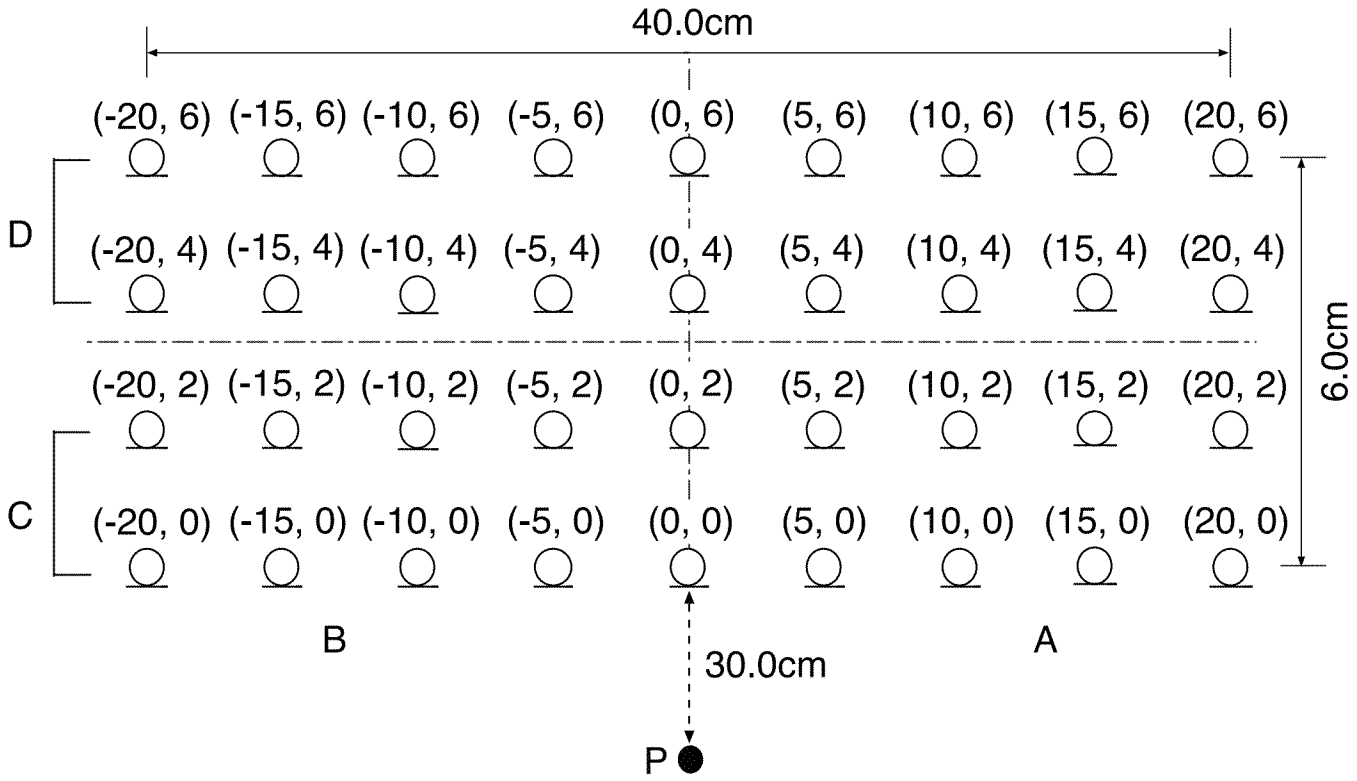
FIG. 13 shows a schematic diagram of an embodiment of a recording environment.

A total of 36 microphones were set up at intervals of 2 cm in the horizontal direction and 5 cm in the vertical direction in the coordinates space of 6 cm×40 cm, and the impact sound was recorded when a golf ball was hit from the direction A toward the direction B (as indicated in FIG. 13.) The distance of sound source P and coordinates (0,0) is assumed to be 30 cm.

Experimental Results

Figure 14:
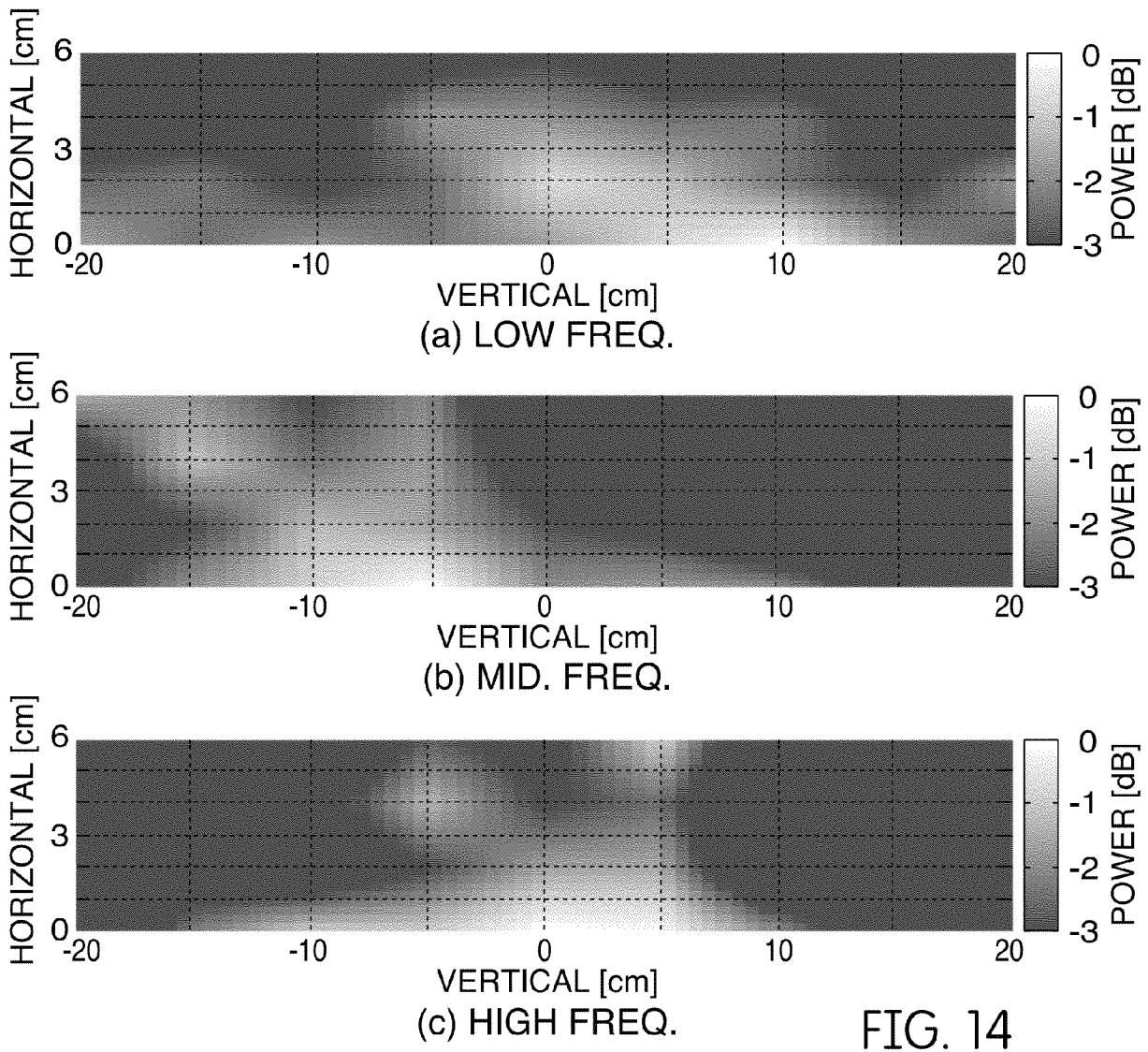
FIG. 14 shows various examples of an acoustic pressure distribution of a recording sound.

The acoustic pressure distribution is shown in FIG. 14. The distribution that averaged low level power (0 kHz, 8 kHz) is shown in (a), the distribution that averaged mid-level power (8 kHz, 16 kHz) is shown in (b), and the distribution that averaged high level power (16 kHz, 24 kHz) is shown in (c). The energy distribution of the impact sound in each frequency can be confirmed from FIG. 14.

Figure 15:
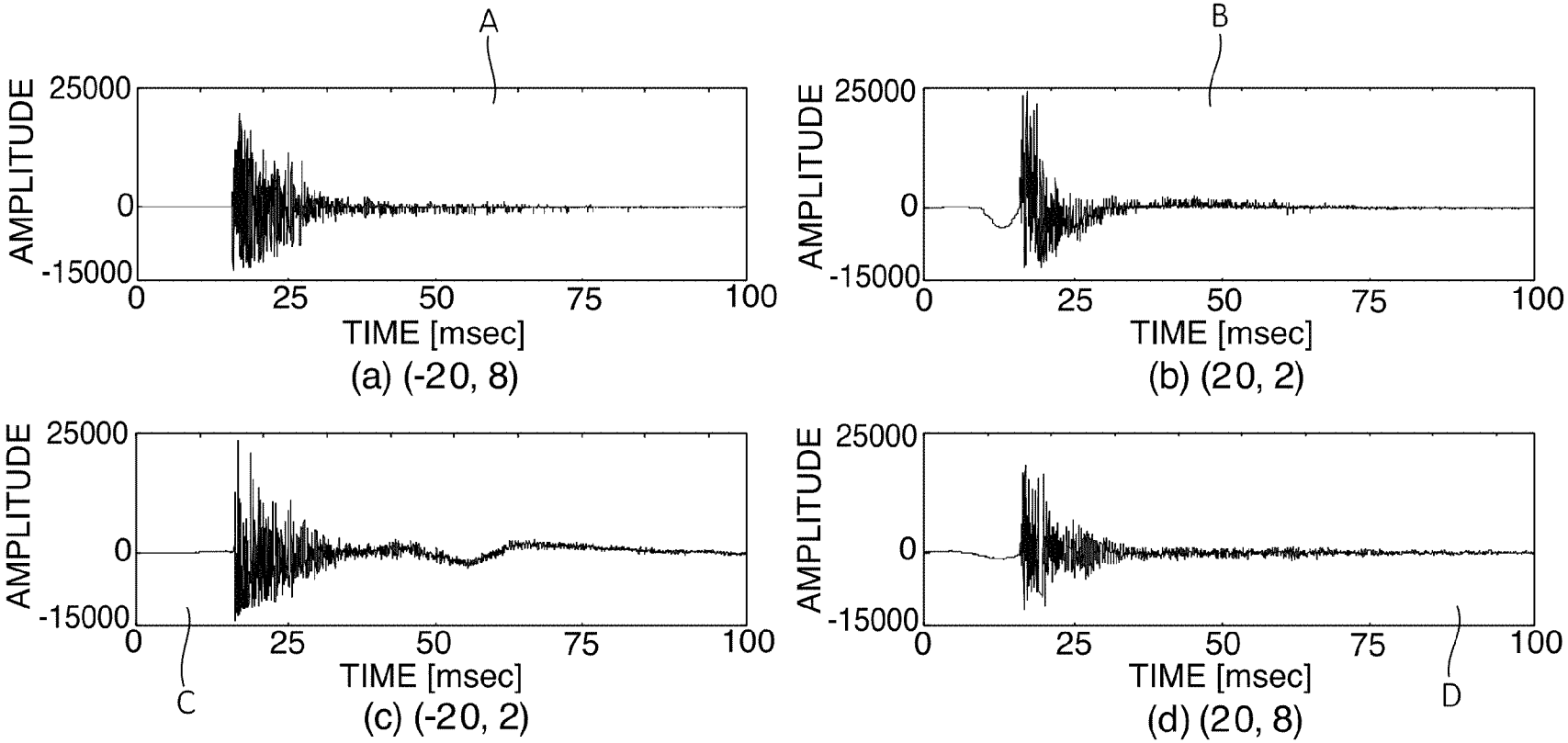
FIG. 15 shows various examples of the wave pattern of a recorded impact sound.

One example of the wave patterns of the recorded impact sound that had remarkable change can be confirmed as is shown in FIG. 15. First waveform A is a waveform that suffers a relatively small influence by wind noise, while second waveform B, third waveform C, and fourth waveform D show waveforms that are greatly influenced by wind noise. Compared with first waveform A, second waveform B, third waveform C, and fourth waveform D clearly show a large fluctuation near the main peak. It is believed that the presence of the influence of the wind noise is indicated by this fluctuation near the main peak, and this fluctuation could be used as a standard for determining wind noise influence on microphones and microphone arrays.

In locations in horizontal direction A as shown in FIG. 13, the influence of wind noise was great, and the experimental result shows that the influence of wind noise was small in locations in vertical direction D. In particular, it was understood that the influence of the wind noise in locations in horizontal direction A and vertical direction C is great, and the influence of the wind noise in locations in horizontal direction B and vertical direction D is small. In addition, the distance from sound source P to the locations in horizontal direction B and vertical direction D is about 40 cm. It is thought that the microphone array was able to control the influence of the wind noise by maintaining a 40 cm focal distance in the area in horizontal direction B and vertical direction D from the sound sources to the microphone. Therefore, for many golf purposes, target point P as shown in FIGS. 1-8 may advantageously be selected to be about 40 cm.

Testing Scenario 2

Figure 1:
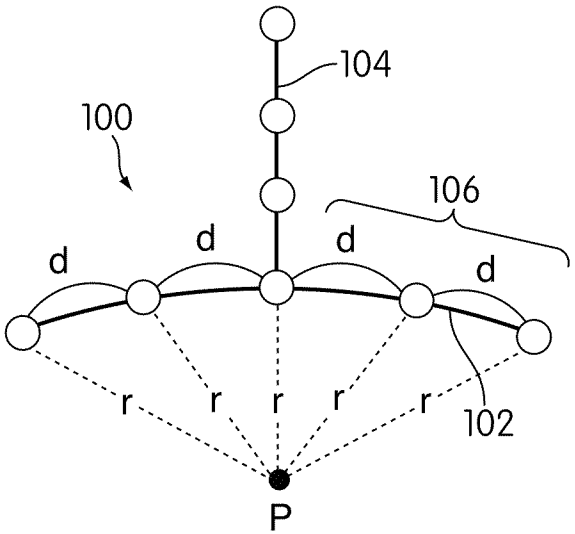
FIG. 1 is a schematic front view of an embodiment of a microphone array stand with a plurality of microphones associated therewith.
Figure 4:
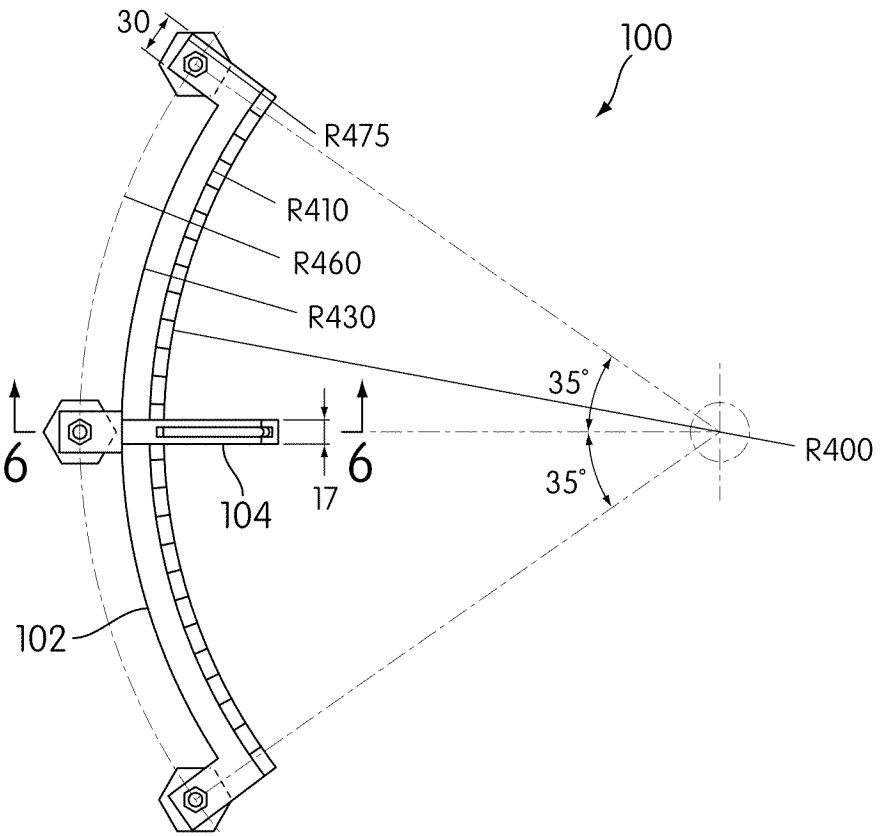
FIG. 4 is a top view of an embodiment of a microphone stand configured to position a plurality of microphones so that each microphone is directed to a focal point.
Figure 3:
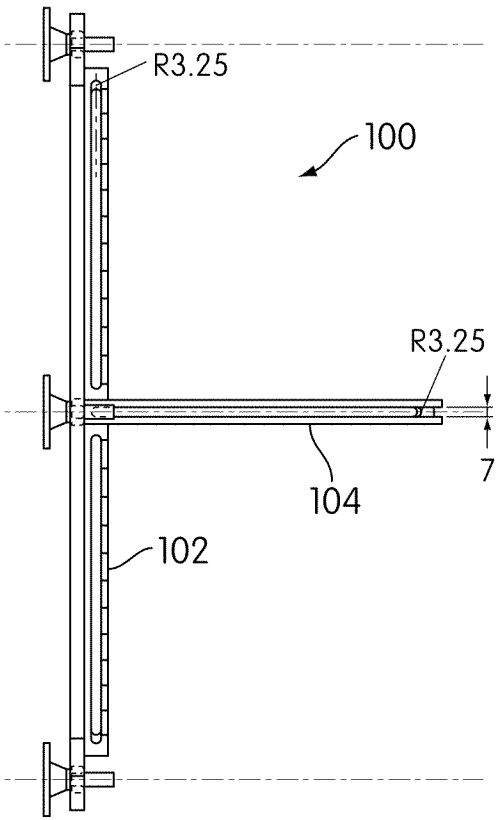
FIG. 3 is a rear view of an embodiment of a microphone stand configured to position a plurality of microphones so that each microphone is directed to a focal point.
Figure 6:
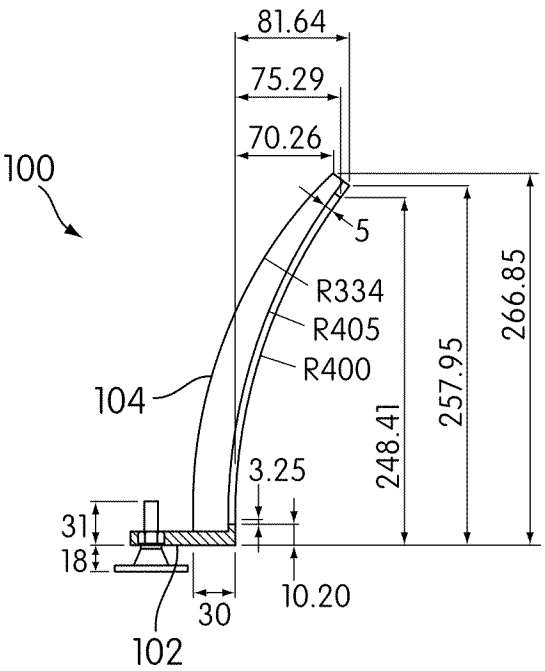
FIG. 6 is a side view of an embodiment of a microphone stand configured to position a plurality of microphones so that each microphone is directed to a focal point.
Figure 5:
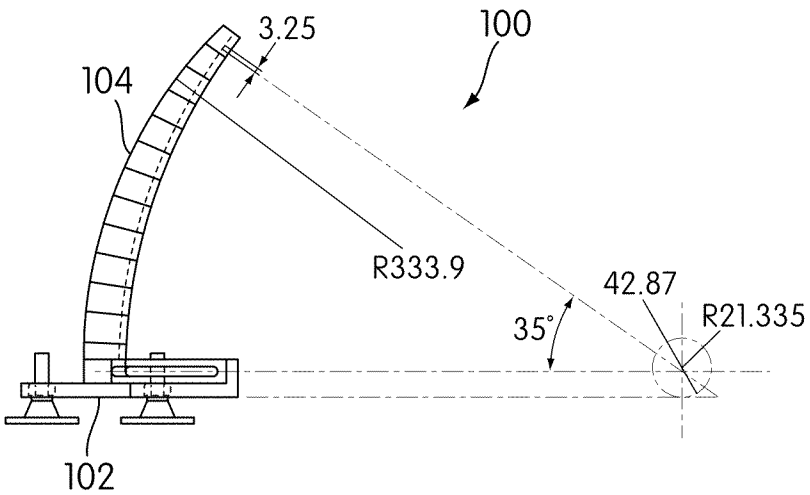
FIG. 5 is a side view of an embodiment of a microphone stand configured to position a plurality of microphones so that each microphone is directed to a focal point.

As a result of the determinations of the wind noise testing, it is understood that the influence of the wind noise can be controlled in some circumstances by keeping the distance of 40 cm from an impact sound source to a microphone. Aiming at a robust extraction of an impact sound profile of high quality against wind noise, the microphones were arranged with a radius of 40 cm in the horizontal direction and the vertical direction. The arrangement of the proposed microphone array is shown in FIGS. 1-2. Target point P is the location of the anticipated impact location. The microphone array includes eight (8) microphones. The purpose of Testing Scenario 2 is to verify that the directivity pattern of the microphone array is changed by changing the proposed microphone arrangement and the microphone interval d (the distance between neighboring microphones.)

Experiment Outline

The testing conditions are set forth generally in Table 2.

TABLE 2

| Conditions for Testing Scenario 2 | |
|---|---|
| Microphone Interval | 6 cm or 12 cm |
| Sampling Frequency | 48 kHz |
| Number of Microphones | 8 |
| Sound Source | Gaussian white noise |

Based on the experiment conditions shown in Table 2, directional characteristics were computed by arranging a sound source about 40 cm in front of the microphone array. The microphone is assumed to have equal intervals, and the directional characteristics are calculated by computer simulation when d is at 6 cm and at 12 cm.

Experimental Results

Figure 16:
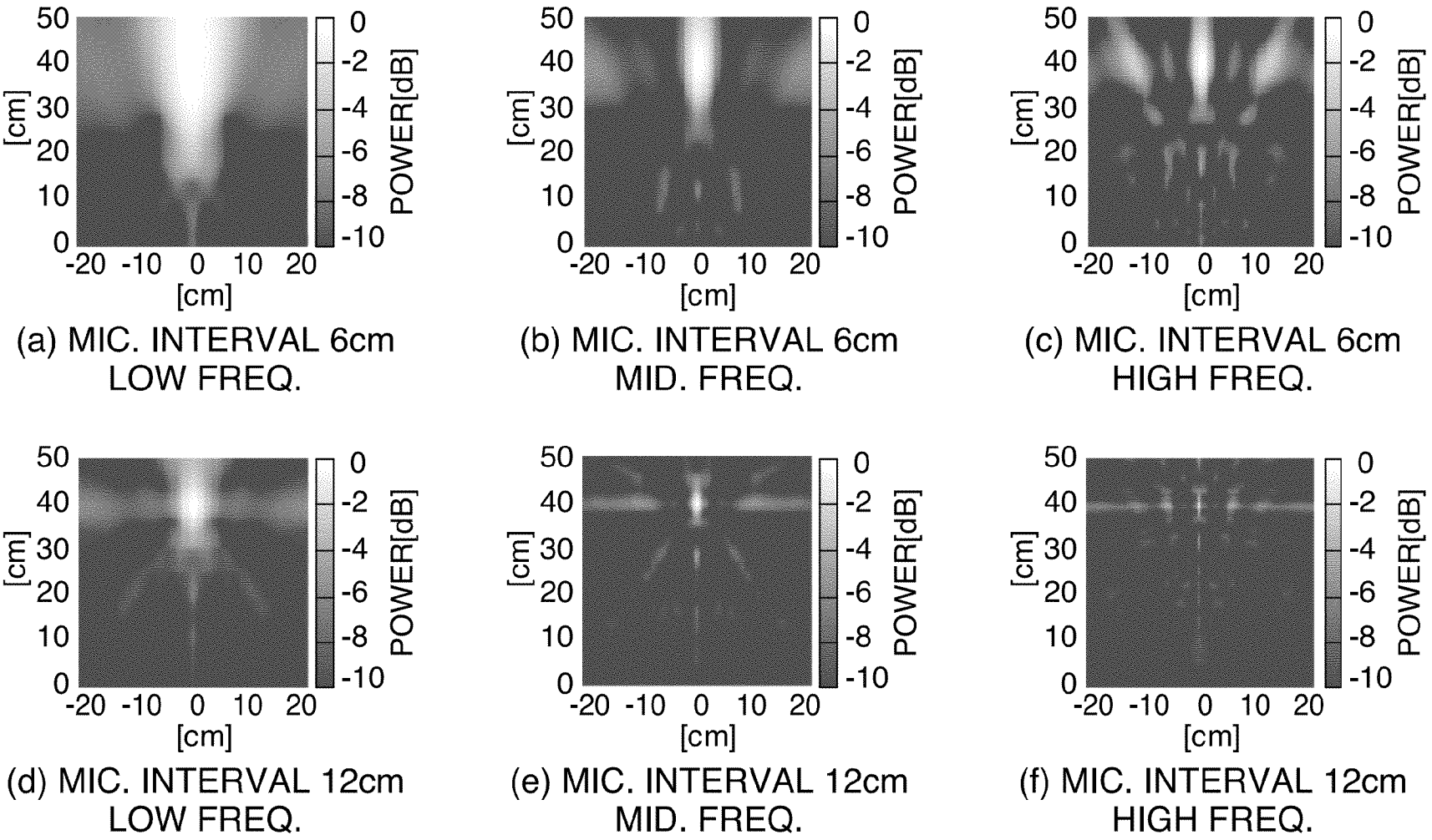
FIG. 16 shows various examples of simulation results of the directivity pattern of an embodiment of a microphone array.

The simulated directivity patterns are shown in FIG. 16. If the averaged power from 0 kHz to 8 kHz is assumed to be low level, the averaged power from 8 kHz to 16 kHz is assumed to be mid-level, and the averaged power from 16 kHz to 24 kHz is assumed to be high level, the frequency band shows low level of directivity pattern in (a), mid-level in (b), and high level in (c) at a microphone distance d of 6 cm. The frequency band shows low level of directivity pattern in (d), mid-level in (e), and high level in (f) at a microphone distance d of 12 cm. As shown in FIG. 16, the directivity response pattern when the microphone interval is 12 cm generally sharpens compared with the case of 6 cm. As such, it is believed that widening microphone intervals sharpens a point characteristic. Moreover, the signal to noise ratio (SNR) near a sound source is so high that frequency will become high in comparison for every frequency. In particular, SNR at the high level improves by about 8 dB when the microphone interval is 6 cm, and improves by about 10 dB when the microphone interval is 12 cm.

Moreover, aliasing in the signal is shown in all graphs displayed in FIG. 16. However, it is thought that the influence of aliasing can be disregarded because the noise origin does not exist and the sound source position is known. This aliasing showed that the proposed microphone arrangement could form sharp directivity by the high SNR in all frequency bands.

An equipment designer may use the information gathered by the sound capturing system described herein for multiple purposes. For example, a designer may be able to determine the most aesthetic impact sound of a particular design based on the number, type, and materials selected for the layers of a golf ball. Also, a golfer's swing may be determined, as off-center hits will sound different from correctly hit balls. The unique sound made by a golf club, a golf ball, and a golfer's swing may provide sufficient swing data to use in a club fitting and/or ball fitting system as an objective component of a swing analysis, such as the ball fitting system disclosed in U.S. Patent Publication 2011/0009215, which is incorporated herein in its entirety by reference.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method for detecting a high quality impact sound generated by a striking object impacting a projectile at a target point, the method comprising:

deploying a plurality of microphones, wherein each microphone in the plurality of microphones is positioned a known distance from any other microphone in the plurality of microphones, and wherein each microphone in the plurality of microphones is focused on the target point;

receiving the impact sound at one or more of the microphones in the microphone array so that one or more of the microphones generates an impact signal;

communicating the impact signal to an analysis module;

analyzing the impact signal to determine the quality of the impact sound; and providing recommendations based upon the quality of the impact sound.

2. The method of claim 1, wherein analyzing the impact signal comprises performing a fast Fourier transform (FFT) of the impact signal.

3. The method of claim 1, wherein analyzing the impact signal comprises determining a peak frequency of the impact signal.

4. The method of claim 1, wherein analyzing the impact signal comprises determining a time shift delay between a first microphone and a second microphone.

5. The method of claim 1, wherein analyzing the impact signal comprises generating a spectrograph using a fast Fourier transform (FFT) of the impact signal to obtain a frequency distribution of the impact signal.

6. The method of claim 1, wherein each of the microphones is deployed on one of a base and an arm of a microphone stand, the base having a first curvature and the arm having a second curvature.

7. The method of claim 1, wherein each microphone is a directional microphone.

8. The method of claim 1, wherein the striking object is a golf club and the projectile is a golf ball.

9. The method of claim 1, wherein the analysis module comprises a delay sum array algorithm that sums signals received from the plurality of microphones after accounting for any time delay in impact signal reception.

10. The method of claim 8, wherein the quality of the impact sound provides swing data that is used in at least one of a club fitting and ball fitting system.

11. The method of claim 8, wherein the recommendations comprise at least one of club fitting and ball fitting recommendations.

12. A method for fitting a golf club or a golf ball based on an impact sound generated by the golf club impacting the golf ball at a target point, the method comprising:

deploying a plurality of microphones, wherein each microphone in the plurality of microphones is positioned a known distance from any other microphone in the plurality of microphones, and wherein each microphone in the plurality of microphones is focused on the target point;

receiving the impact sound at one or more of the microphones in the microphone array so that one or more of the microphones generates an impact signal;

communicating the impact signal to an analysis module;

analyzing the impact signal to determine the quality of the impact sound; and fitting at least one of the golf club and the golf ball based upon the analysis of the impact signal.

13. The method of claim 12, wherein the analysis of the impact signal provides swing data for use in fitting the at least one golf club and golf ball.

14. The method of claim 12, wherein the impact sound is an objective component of a swing analysis.

15. The method of claim 12, wherein the analysis of the impact signal is used to identify off-center hits.

16. The method of claim 12, wherein the analysis of the impact signal comprises a fast Fourier transform.

* * * * *